United States Patent [19]

Wainwright

[11] 4,014,056

[45] Mar. 29, 1977

[54] TANK MOUNTING MEANS

[76] Inventor: Richard A. Wainwright, 10504 Wheatly St., Kensington, Md. 20795

[22] Filed: Jan. 26, 1976

[21] Appl. No.: 652,087

[52] U.S. Cl. ..... 9/1.7; 114/74 R; 211/71; 248/311.1

[51] Int. Cl.[2] ..... B63B 17/00

[58] Field of Search ..... 9/1.7, 1.1; 114/74 R, 114/75; 211/71, 4; 248/25, 27, 311.1, 500, 499, 315, 316 R; 220/15, 18, 69; 403/252, 256, 257, 261; 224/29 R; 292/292

[56] References Cited

UNITED STATES PATENTS

| | | | |
|---|---|---|---|
| 2,034,868 | 3/1936 | Henriksen | 220/69 |
| 2,539,453 | 1/1951 | Marlow et al. | 114/74 R |
| 2,661,113 | 12/1953 | Benson | 220/85 P |
| 2,773,480 | 12/1956 | Kosher | 248/311.1 |
| 3,180,663 | 4/1965 | Lehmann | 403/257 |

*Primary Examiner*—Trygve M. Blix
*Assistant Examiner*—Stuart M. Goldstein
*Attorney, Agent, or Firm*—Kirschstein, Kirschstein, Ottinger & Frank

[57] ABSTRACT

A marine tank mount for vessels characterized by a proximately horizontal rack mounted on a deck or other member of the vessel and provided with an opening. A tank is mounted on the rack, with the annular bottom flange of the tank extending downwards through the opening. A pair of diametrically opposed holes are provided in the flange below the level of the rack, and a locking bar which may or may not be made of spring-like material is inserted through the holes, whereby the tank is attached to the vessel above the deck of the vessel. The tank will typically contain a fuel such propane, butane or gasoline or other highly volatile and inflammable fuel, or may alternatively contain a fluid chemical or the like which may be corrosive in nature.

16 Claims, 7 Drawing Figures

76
86
74
88
80
76
78
82
72
84
76
90
92
94
96

TANK MOUNTING MEANS

BACKGROUND OF THE INVENTION

1. Field of the Invention

The invention pertains to the mounting of tanks containing liquid fuels or the like on vessels such as sailboats, yachts, motorboats, cabin cruisers, tugboats and the like. The storage of volatile-flammables such as propane, butane, gasoline, etc., presents a serious problem to yachtsmen and other operators of smaller to medium-sized vessels or boats. Storage of these gases or fuels should be as far aft on a boat as is conveniently possible, and should be located on or in a completely open area so that any discharge or fumes will not be collected or concentrated on or below decks or in closed compartments where a spark could ignite the fumes or vapors, which could seriously damage a boat or injure its occupants. In addition, the salt spray environment causes rapid deterioration of most metals, which is enhanced in closed-compartment storage where water vapor can accumulate and circulate.

Direct on-deck mounting of tanks is undesirable because of the deposition of rust sains on the deck and also because the decks of small craft such as a sailboat are usually awash with sea water, thus the tank bottoms are immersed partialy or periodicaly in salty sea water while sailing.

2. Description of the Prior Art

Numerous prior art references disclose relatively complex racks for holding tanks such as propane gas bottles. U.S. Pat. No. 2,985,310 discloses a gas bottle rack having a base plate with front and rear flanges that are cut away to nestingly receive the lower necks of gas bottles. The upper necks of the gas bottles are embraced by a pair of clamp bars which are secured to the baseplate by a hold down rod. U.S. Pat No. 2,639,208 discloses a gas bottle rack for trailers having a base plate to which is rigidly secured spaced annular upstanding ring members attached to receive the annular bottom flanges of conventional gas bottles. An upstanding member, positioned between the ring members, supports a flanged top cover member overlying the bottle neck portions. Locking means holds the cover member to the upstanding member to retain the gas bottles on the horizontal plate.

SUMMARY OF THE INVENTION

Purposes of the Invention

It is an object of the present invention to provide an improved marine tank mount for vessels.

Another object is to provide an improved above-deck marine tank mount.

A further object is to provide a marine tank mount which restrains tanks on vessels in a simple yet highly effective manner.

An additional object is to provide a marine tank mount which attains a high degree of safety with regard to the mounting of tanks containing dangerous fuels, corrosive chemicals or the like on vessels.

Still another object is to provide a marine tank mount which diminishes the corrosion of tanks mounted on vessels, especially vessels operating in sea water, so as to effectively prevent paint peeling, deck stains, etc.

Still a further object is to provide an above-deck marine tank mount for vessels which prevents the accumulation of dangerous fumes and/or vapors in the vessel, when the tank contains volatile fuels or chemicals or the like.

These and other objects and advantages of the present invention will become evident from the description which follows.

Brief Description of the Invention

In the present invention, an improved marine tank mount for vessels is provided which comprises an above-deck horizontal rack provided with an opening which accommodates the lower flange of a tank. The tank thus is mounted on the rack, and the lower flange is provided with two or more holes so spaced that a locking bar is inserted through the two holes below the level of the rack, said holes or slots are usually a part of tanks or this part as supplied by commerical sources, so that the tank is restrained from motion or upset when the vessel itself is in motion on a river, lake, bay, ocean or other body of water. The rack is preferably disposed toward or at the stern of the vessel, and several modifications or alternative embodiments of rack configuration and disposition are contemplated as being within the scope of the present invention. Thus, the rack may be disposed immediately above the deck, with vertical members depending downwards from the horizontal portion of the rack to lower attachment to the deck. In an alternative embodiment, the rack is attached to the stern deck rail or railing adjacent to the stern of the vessel.

In any event, the above-deck marine tank mount of the present invention provides several salient advantages. The open mounting provided by the mounts described and claimed herein allows free and open dissipation of hazardous fumes, allows quick drying for removal of any accumulated moisture, and by providing an off-the-deck mounting there are no rust stain deposits on decks. Direct on-deck mounting of tanks is undesirable because the decks of a sailboat or the like are usually awash with sea water, thus the tank bottoms are immersed partially in salty sea water while sailing. Further, by off-the-deck mounting such as the stern rail mount it is but a simple matter to rinse off salt deposits either naturally by rainfall or with fresh water from a hose. After nearly a year of pleasure sailing with the device of the present invention installed on an ocean-going sailboat, it was found that paint finishes last significantly longer than direct deck lashing down of the propane tanks.

Almost every sailboat or yacht site has bar-like stern rails hence the stern rail mount would be desirable for such craft. As for power boats, variations of the "deck-mount" devices is desirable, with the location of the mount being in an area that is out of the way of traffic yet where there is a free flow of fresh air. This will typically be on the stern of the boat, preferably on the stern as far aft as is practical so that any accidental spillage will be discharged overboard and away from the craft, and so that any vapors or fumes will be dissipated and not permeate the craft.

BRIEF DESCRIPTION OF THE DRAWINGS

Referring now to the drawings.

DETAILED DESCRIPTION OF THE PREFERRED EMBODIMENTS

Figure 1:
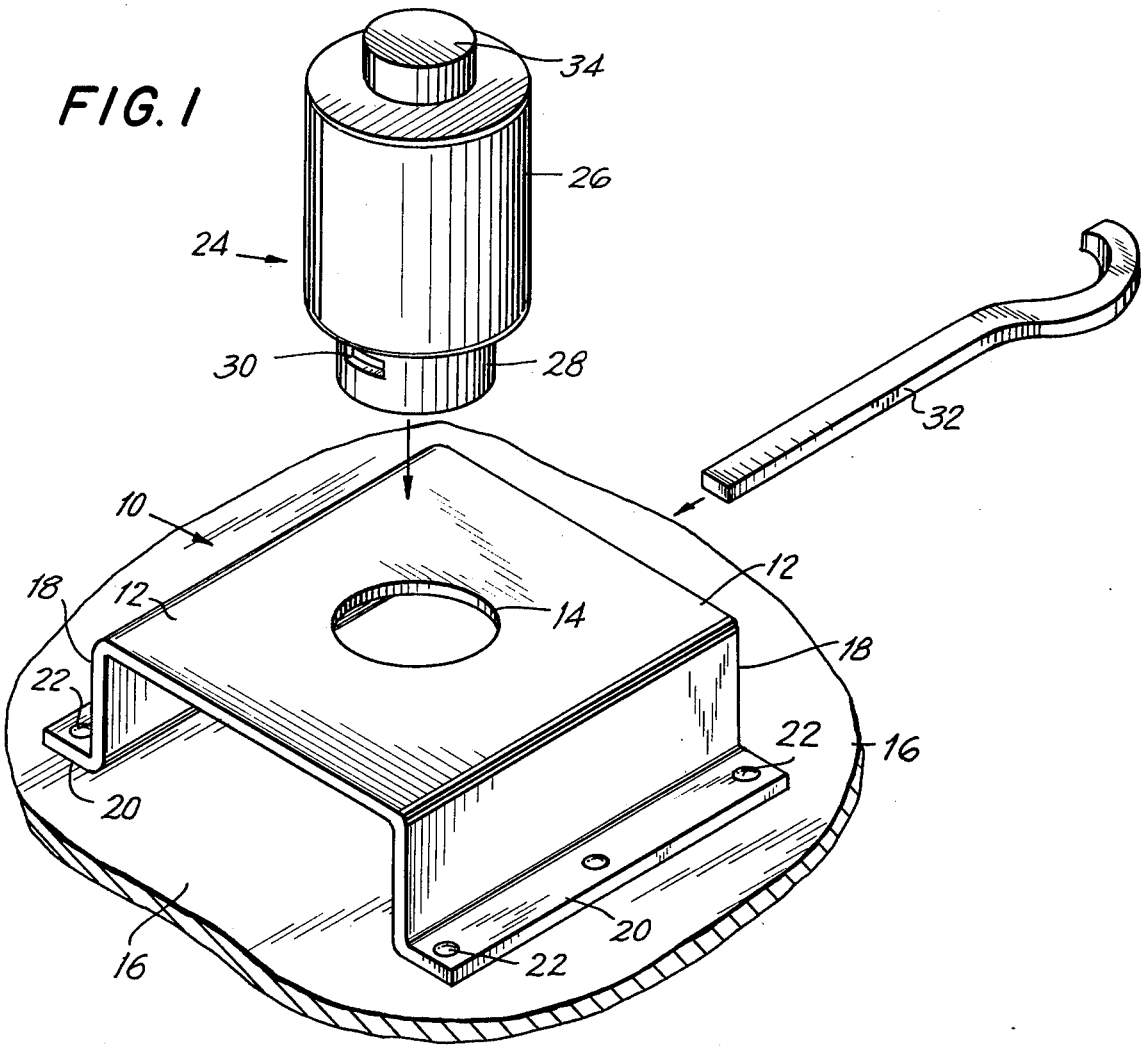
FIG. 1 is a perspective view of a typical embodiment of the marine tank mount as applicable to deck mounting of tanks, with an exploded view of the tank and locking bar appurtenances.

Referring now to FIG. 1, a typical marine tank mount configuration for deck mounting of a tank is shown. The mount 10 is characterized by an upper horizontal portion or rack 12 which is provided with a typically circular central opening 14. Horizontal portion or rack 12 of the mount 10 is supported above deck 16 of a vessel by the parallel vertical sections 18 which depend downwardly from the outer edges of horizontal portion 12 to lower flanges 20, which secure the mount 10 to deck 16 via mounting screw holes, 22, into which screws or bolts extend in practice so as to securely attach mount 10 to the deck 16. In the exploded view of FIG. 1, the preferably cylindrical tank 24 is shown as located above the mount 10, however it will be understood that in practice the tank 24 will rest on the horizontal portion or rack 12 of mount 10, with the body 26 of the tank extending upwards from portion 12 and with the annular bottom flange 28 of the tank 24 extending downwardly through the opening 14. One of two diametrically opposed holes 30 in flange 28 is shown in FIG. 1. The holes 30 are so disposed as to be below the level of portion 12 when the tank 24 is in place on the mount 10. A locking bar 32 is also shown in the exploded view of FIG. 1. In service, the locking bar 32 will be disposed in place under section or portion 12 of mount 10 and will extend through the holes 30, so as to prevent any motion or displacement of the tank 24 when the vessel is in motion or is subject to violent storms at sea which may cause the vessel to pitch or roll with the waves. The motion of vessels when subjected to heavy seas is well known to those skilled in the art. The tank 24 is also provided with the usual upper fittings and valving section 34, which is of course of a conventional design well known to those silled in the art and does no enter into the novel aspects of the present invention.

Figure 2:
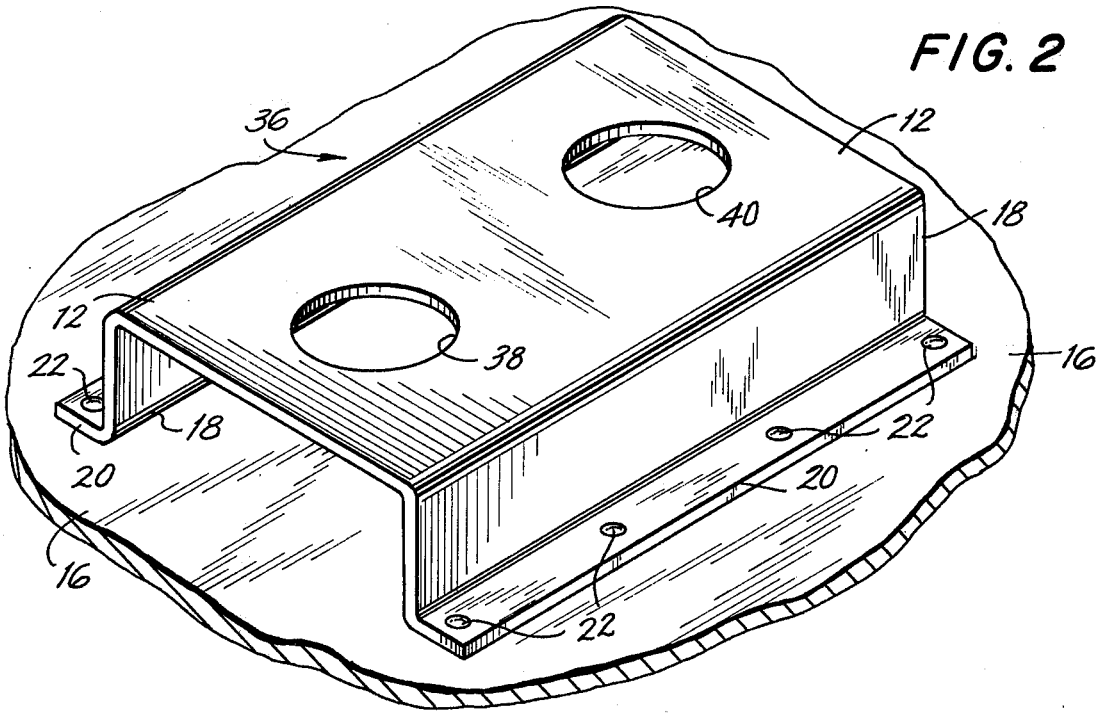
FIG. 2 is a perspective view of an alternative marine tank mount for deck mounting of a plurality of tanks, specifically in this embodiment for the mounting of two tanks.

Referring now to FIG. 2, an alternative embodiment of a deck-mounted marine tank mount designed to accommodate two tanks is shown. The basic configuration of the FIG. 2 embodiment is comparable to FIG. 1, except that the tank mount 36 of FIG. 2 is characterized by being elongated relative to the mount 10 of FIG. 1, so as to accommodate two openings 38 and 40 which accommodate their respective tanks, not shown.

It will be appreciated that the deck mount 10 of FIG. 1, or the mount 36 of FIG. 2, will preferably be located at or near the stern of the respective vessel in practice. In addition, although the tank 24 of FIG. 1 has been shown as being cylindrical, which is the conventional geometric design for a tank, and the openings 14 of FIG. 1 and 38 and 40 of FIG. 2 have been shown as being circular, other convenient configurations such as a square or rectangular configuration may be adopted in practice.

Figure 3:
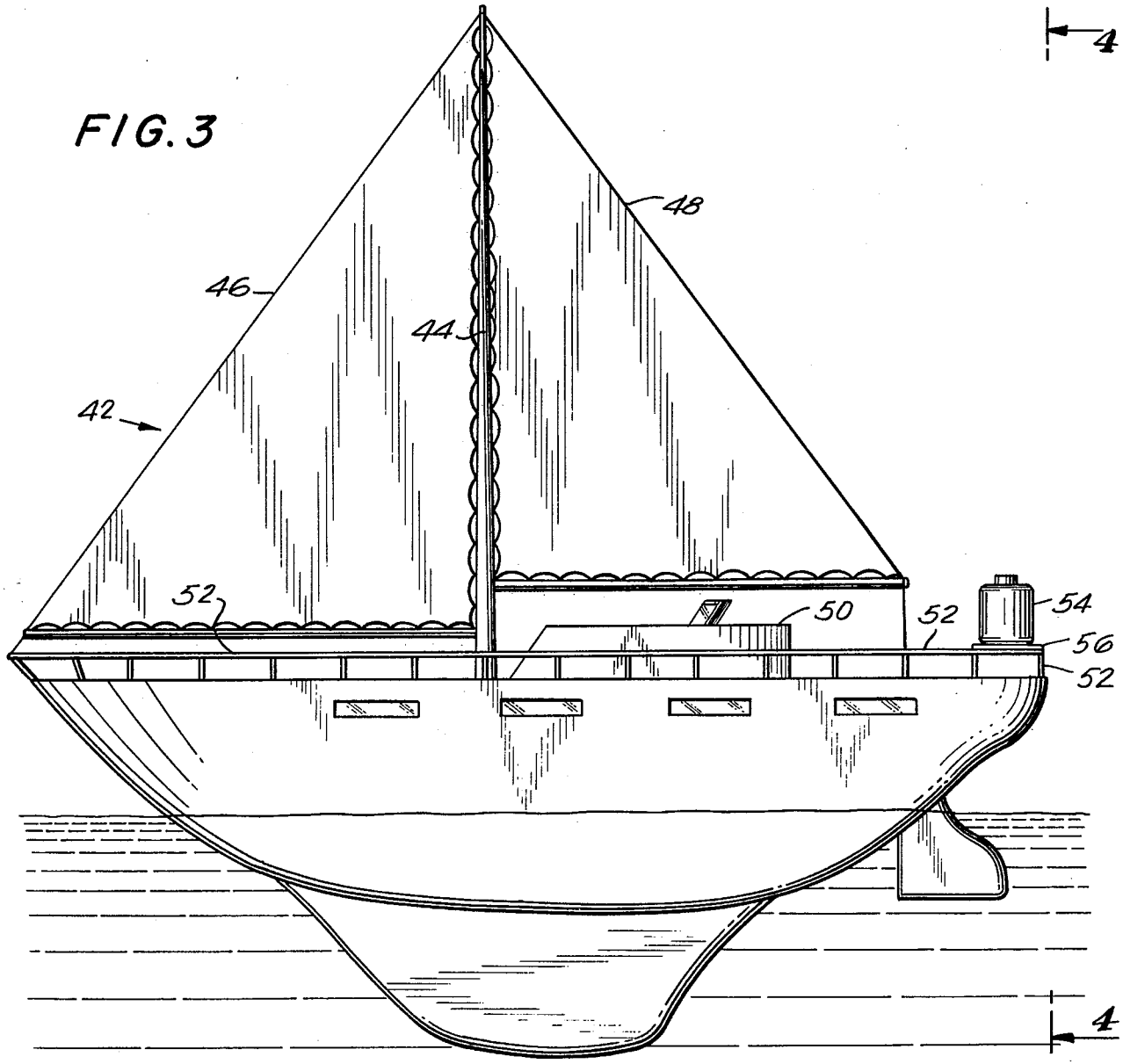
FIG. 3 is an elevation view of stern mount of tanks on the stern rail of a typical sailboat.

Referring now to FIG. 3, the sailboat 42 is provided with the usual sailboat appurtenances such as mast 44, fore or front sail 46, aft or rear sail 48, cabin 50, and deck rail 52. FIG. 3 illustrates the stern mount of tanks 54 on the stern rail of a typical sailboat. One of the two tanks 54 is shown in FIG. 3, mounted on the marine tank mount 56 which in turn is attached to the upper horizontal rail of the deck railing 52 at the stern of the vessel 42.

Figure 4:
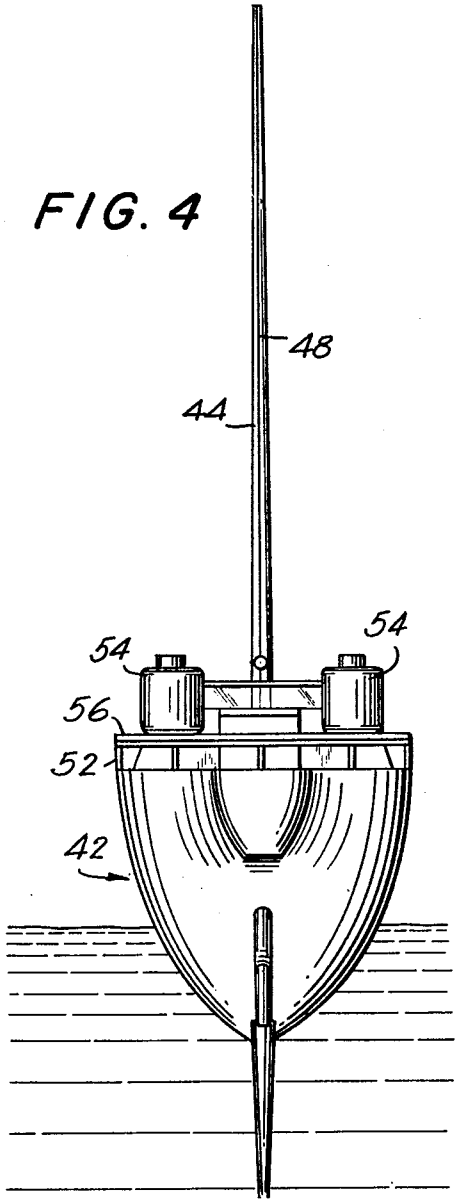
FIG. 4 is an elevation view of the marine tank mount embodiment of FIG. 3, taken on the lines 4—4.

FIG. 4 is an elevation view of FIG. 3 taken on section 4—4, and FIG. 4 is intended to show with greater clarity the stern mounting of the tanks 54 on the marine tank mount 56 which is attached to the deck rail 52 at the stern of the vessel 42.

Figure 5:
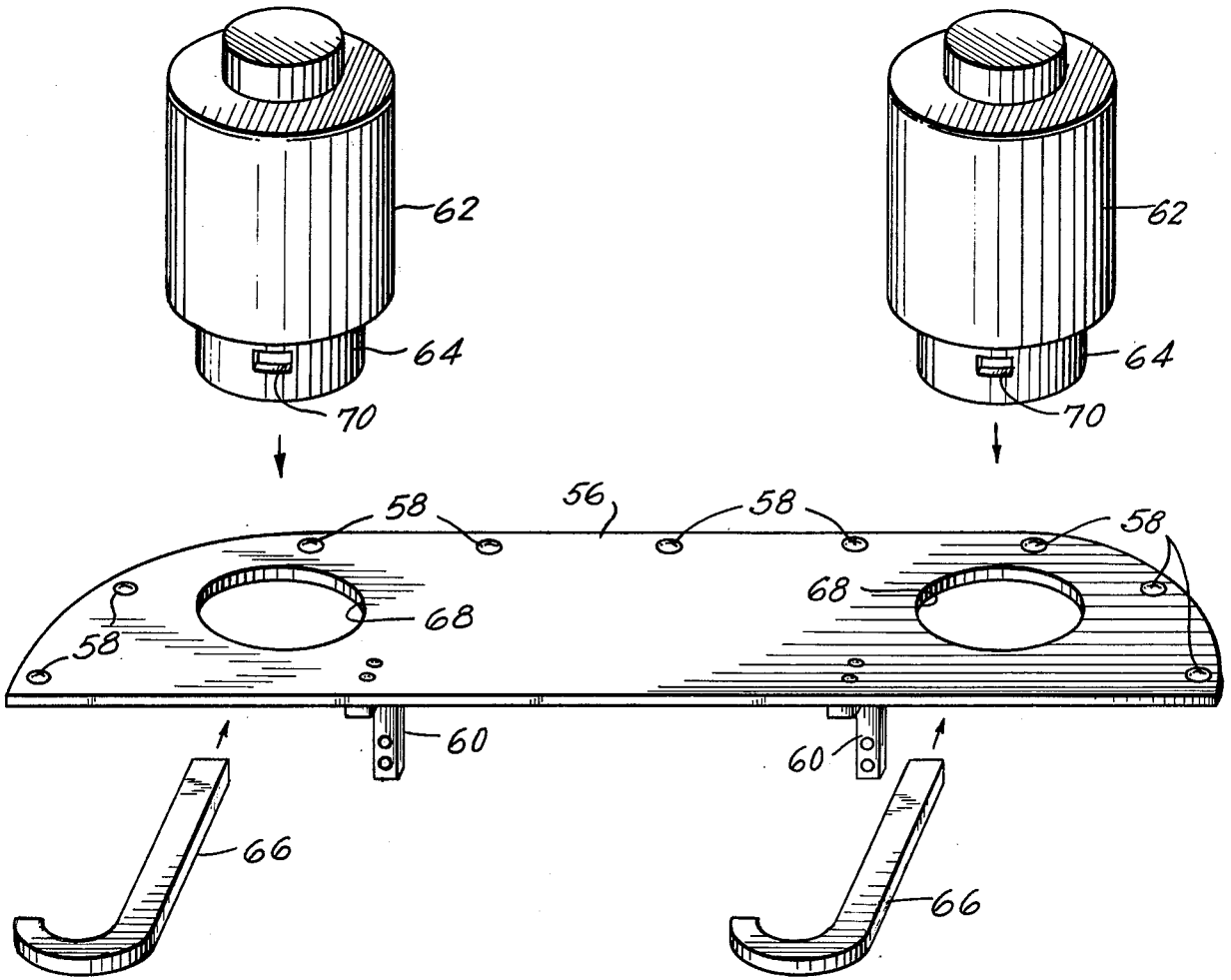
FIG. 5 is an exploded perspective view of the stern mount arrangement per se of FIGS. 3 and 4.

FIG. 5 is an enlarged and exploded isometric view of the stern-mounted marine tank mount 56 of FIGS. 3 and 4. The mount 56 extends completely across the stern of the vessel and is in the form of a tank mounting platform which is attached to the horizontal portion of the stern deck rail via screws or bolts, not shown, which extend through holes 58. Unit 56 is also supported by brackets 60 which are tied or attached to the vertical members of the stern rail. The tanks 62 which are typically filled with propane for usage as a fuel, are provided with annular bottom flanges 64 comparable to the flange 28 described above. Locking bars or rods 66 comparable to bar 32 described above are also provided. It will be apparent that the space on platform 56 between the two tanks 62 may be usefully employed for storage of gasoline cans or the like. Finally, the assemblage of the elements in FIG. 5 in service is comparable to that described in FIG. 1, i.e., tanks 62 rest on the upper surface of the marine tank mount 56, with the annular bottom flanges 64 extending downwardly through the openings 68 in mount 56. The locking bars 66 when in place each extend through the holes 70 in the respective flange 64 of the tank 62, below the mount 56.

Figures 6, 7:
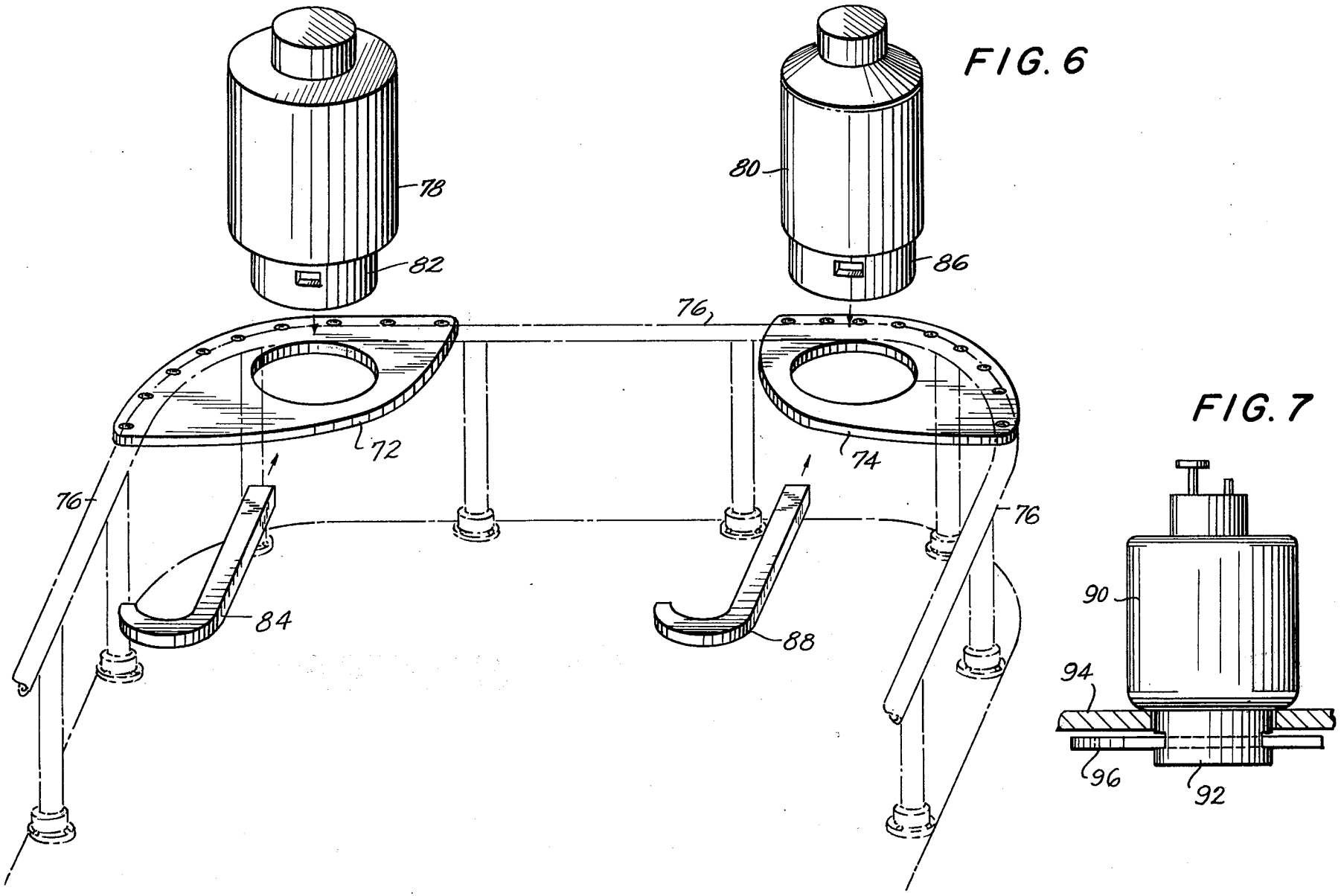
FIG. 6 is an exploded perspective view of an alternative stern rail mount embodiment of the invention.
FIG. 7 is an elevation view which shows a tank in place on a typical marine tank mount of the present invention with the locking bar in place.

Referring now to FIG. 6, this embodiment of the invention is characterized by the provision of separate tank mounts on either side of the stern ral of a vessel. The marine tank mounts 72 and 74 may be clipped, clamped or bolted to the horizontal member 76 of the stern rail, as desired. It is to be noted that the tank 78 which cooperates with mount 72 is of a different configuration from the tank 80 which cooperates with mount 74. This difference emphasizes that the two tanks 78 and 80 may be provided for entirely different purposes and may contain entirely different materials, chemicals, fuels or other fluids, e.g., tank 78 may contain water and tank 80 may contain propane or gasoline. However, in both instances the marine tank mount configuration is comparable, i.e., annular bottom flange 82 on tank 78 which cooperates with mount 72 and locking bar 84; and annular bottom flange 86 on tank 80 which cooperates with mount 74 and locking bar 88.

FIG. 7 is a sectional elevation view showing the several elements of the combination of the present invention in their respective cooperating positions in the practice of the invention, i.e., tank 90 provided with annular bottom flange 92, marine tank mount 94, and locking bar 96, all in place as when in service.

Numerous alternatives within the scope of the present invention, besides those alternatives mentioned above, will readily occur to those skilled in the art.

Thus, the various holes 30, 70, etc., in the tank bottom flanges may alternatively be circular in which case the respective locking bars 32, 66, etc., would be cylindrical bars.

More than two holes may be provided in each annular bottom flange, e.g., four holes could be provided in two parallel pairs so that two parallel locking bars would be provided for each installation of the device. Finally, as previously mentioned, the bottom flanges 28, 64, 82 and 86 and respective mount openings 14, 68, etc., are preferably circular however alternate configurations such as square or rectangular or even elliptical may be adopted in practice.

In summary the objects of the present invention have been achieved by providing a marine tank mount for above-deck stable mounting of a tank by means of lower flange on the tank which cooperates with the mount and the locking bar in combination to provide an improved apparatus for the purposes outlined above.

It will be understood by those skilled in the art that although a preferred and alternative embodiments have been shown and described in accordance with the Patent Statutes the invention is not limited thereto or thereby.

Having thus described the invention, there is claimed as new and desired to be secured by Letter Patent:

1. A marine tank mount for a water surface traversing vessel comprising a rack, said rack being attached to a deck member of the vessel, the deck member being disposed above the water surface, said rack being above the vessel deck and at least partially horizontal, the horizontal portion of said rack being provided with at least one opening, at least one tank, said tank being provided with a bottom flange, said tank beng mounted on said rack whereby said flange extends downwardly through said opening, the portion of said flange below said rack being provided with at least two holes, and a locking bar, said bar extending through said holes, whereby said tank is attached to said vessel above the deck of the vessel.

2. The marine tank mount of claim 1, in which said deck member of said vessel is said deck, and said horizontal portion of said rack is elevated above said deck by vertical portions of said rack which depend from said horizontal portion to lower attachment to said deck.

3. The marine tank mount of claim 1, in which said deck member of said vessel is the rail of said deck.

4. The marine tank mount of claim 3, in which said rail is the stern rail of said deck.

5. The marine tank mount of claim 4, in which said rack extends across the entire stern rail of said deck, and said rack is provided with a plurality of openings, whereby a plurality of tanks are mounted on said rack.

6. The marine tank mount of claim 4, in which said rack is disposed at a corner of said stern rail.

7. The marine tank mount of claim 1, in which said opening is circular, said tank is cylindrical, said bottom flange is an annular bottom flange, and said holes are diametrically opposed.

8. The marine tank mount of claim 1, in which said tank contains a fuel selected from the group consisting of propane, butane and gasoline.

9. The marine tank mount of claim 1, in which said locking bar is made of spring-like material.

10. A marine tank mount for vessels comprising a rack, said rack being attached to the rail of the deck of a vessel, said rack being at least partially horizontal, the horizontal portion of said rack being provided with at least one opening, at least one tank, said tank being provided with a bottom flange, said tank being mounted on said rack whereby said flange extends downwardly through said opening, the portion of said flange below said rack being provided with at least two holes, and a locking bar, said bar extending through said holes, whereby said tank is attached to said vessel above the deck of the vessel.

11. The marine tank mount of claim 10, in which said rail is the stern rail of said deck.

12. The marine tank mount of claim 11, in which said rack extends across the entire stern rail of said deck, and said rack is provided with a plurality of openings, whereby a plurality of tanks are mounted on said rack.

13. The marine tank mount of claim 11, in which said rack is disposed at a corner of said stern rail.

14. The marine tank mount of claim 10, in which said opening is circular, said tank is cylindrical, said bottom flange is an annular bottom flange, and said holes are diametrically opposed.

15. The marine tank mount of claim 10, in which said tank contains a fuel selected from the group consisting of propane, butane and gasoline.

16. The marine tank mount of claim 10, in which said locking bar is made of spring-like material.

* * * * *